United States Patent [19]

Fiedler

[11] 4,113,529

[45] Sep. 12, 1978

[54] METHOD OF PRODUCING SILICON-IRON SHEET MATERIAL WITH COPPER AS A PARTIAL SUBSTITUTE FOR SULFUR, AND PRODUCT

[75] Inventor: Howard C. Fiedler, Schenectady, N.Y.

[73] Assignee: General Electric Company, Schenectady, N.Y.

[21] Appl. No.: 837,504

[22] Filed: Sep. 29, 1977

[51] Int. Cl.[2] ..... H01F 1/04

[52] U.S. Cl. ..... 148/111; 75/123 L; 148/31.55; 148/112; 148/113

[58] Field of Search ..... 148/111, 112, 113, 31.55; 75/123 L

[56] References Cited

U.S. PATENT DOCUMENTS

| | | | |
|---|---|---|---|
| 3,855,021 | 12/1974 | Salsgiver et al. | 75/123 L |
| 3,929,522 | 12/1975 | Salsgiver et al. | 75/123 L |
| 4,054,470 | 10/1977 | Malagari, Jr. | 148/31.55 |

*Primary Examiner*—W. Stallard

*Attorney, Agent, or Firm*—Charles T. Watts; Joseph T. Cohen

[57] ABSTRACT

Weld brittleness of silicon-iron can be reduced without loss of excellent magnetic properties by limiting the sulfur content to not more than 0.018 percent and using copper as a partial substitute for sulfur as a normal grain growth inhibitor during the final texture-developing anneal.

7 Claims, 4 Drawing Figures

METHOD OF PRODUCING SILICON-IRON SHEET MATERIAL WITH COPPER AS A PARTIAL SUBSTITUTE FOR SULFUR, AND PRODUCT

The present invention relates generally to the art of producing electrical steel and is more particularly concerned with a novel method of producing singly oriented silicon-iron sheet having both good weldability characteristics and excellent magnetic properties and is also concerned with the resulting new product.

CROSS REFERENCE

This invention is related to the invention disclosed and claimed in U.S. patent application Ser. No. 837,505 filed of even date herewith and assigned to the assignee hereof and directed to the novel concept of limiting the sulfur content in silicon-iron melt and using tin to inhibit normal grain growth during the final anneal and thereby reducing or eliminating weld brittleness while retaining excellent magnetic properties in the resulting product.

BACKGROUND OF THE INVENTION

The sheet materials to which this invention is directed are usually referred to in the art as "electrical" silicon steels or, more propertly, silicon-irons and are ordinarily composed principally of iron alloy with about 2.2 to 4.5 percent silicon and relatively minor amounts of various impurities and very small amounts of carbon. These products are of the "cube-on-edge" type, more than about 70 percent of their crystal structure being oriented in the (110)[001] texture, as described in Miller Indices terms.

Such grain-oriented silicon-iron sheet products are currently made commercially by the sequence of hot rolling, heat treating, cold rolling, heat treating, again cold rolling and then final heat treating to decarburize, desulfurize and recrystallize. Ingots are conventionally hot-worked into a strip or sheet-like configuration less than 0.150 inch in thickness, referred to as "hot-rolled band." The hot-rolled band is then cold rolled with appropriate intermediate annealing treatment to the finished sheet or strip thickness usually involving at least a 50 percent reduction in thickness, and given a final or texture-producing annealing treatment. As an alternative practice set forth, for example, in my U.S. Pat. No. 3,957,546, assigned to the assignee hereof, the hot-rolled band is cold rolled directly to final gauge thickness.

In boron- and nitrogen-containing silicon-irons of the kinds disclosed and claimed in U.S. Pat. Nos. 3,905,842 and 3,905,843 assigned to the assignee hereof, strong restraint to normal grain growth and thus promotion of secondary recrystallization to a precise (110)[001] grain orientation is the result of controlling the ranges of these constituents. The sulfur effective for this purpose is that which is not combined with strong sulfide-forming elements such as manganese, a presently unavoidable impurity in iron and steel. Thus, the total sulfur is necessarily greater than that necessary to provide its grain growth inhibition effect.

It is also generally recognized in the art that the presence of high total sulfur and a small quantity of boron can lead to marked brittleness in welds made in the silicon-iron alloy. Because of this weld brittleness, it has not been generally possible to weld two hot rolled coils together for cold rolling as would be a desirable operating practice since reducing the sulfur content for that purpose would have the result of degrading the magnetic properties of the metal.

SUMMARY OF THE INVENTION

I have discovered that in certain silicon-iron heats containing boron and nitrogen the sulfur requirements for grain growth inhibition can be met to a greater or lesser degree through the use of copper. Further, I found that copper additions for that purpose do not increase weld brittleness. In other words, I have discovered how to produce heats having both the excellent magnetic properties associated with high sulfur content and the desirable weld characteristics associated with low sulfur content.

Specifically, I have found that the foregoing new results can be consistently obtained in heats requiring more than 0.018 percent sulfur by adding copper in amounts equivalent to the sulfur deficiency. For purposes of normal grain growth inhibition essential to secondary recrystallization in the development of excellent magnetic properties, I have found that 0.1 percent of copper is equivalent to 0.001 percent sulfur in heats containing 0.02 to 0.03 percent manganese while in heats containing 0.035 to 0.05 percent manganese the equivalency doubles to 0.002 percent sulfur. Still further, I discovered that these new results and advantages can be consistently obtained in silicon-iron containing three to 35 parts per million boron, 30 to 60 ppm nitrogen in the ratio to boron of one part to 15 parts per part of boron, and containing from 0.001 to 0.018 percent sulfur and consequently containing from 1.7 to 0.1 percent copper.

Still another finding that I have made is that magnetic properties can be still further enhanced in silicon-iron to which copper has thus been added by applying the boron-containing coating to the cold rolled silicon-iron sheet prior to the final heat treatment.

The initial hot rolling temperature has likewise been found to have a noticeable effect on permeability in these copper-addition silicon-iron alloys. Thus, sheets of the foregoing composition hot rolled from 1250° C. consistently have higher permeability than those hot rolled from 1200° C.

In view of these several discoveries of mine, those skilled in the art will understand that this invention has both method and product aspects. The product is a cold rolled sheet containing boron, nitrogen, sulfur and copper in controlled amounts enabling development of desired magnetic properties and weldability in the finished sheet material. The process by which the sheet material is produced is likewise novel, particularly in the new critical sulfur and copper proportioning step.

Briefly described, in its article aspect this invention takes the form of a cold rolled silicon-iron sheet product containing 2.2 to 4.5 percent silicon aand from three to 35 parts per million boron, from 30 to 75 ppm nitrogen in the above stated ratio range of boron, from 0.02 to 0.05 percent manganese, and sulfur and copper in amounts ranging, respectively, from 0.001 to 0.013 percent and 1.3 to 0.1 percent in the lower portion of the manganese range and ranging, respectively, from 0.002 to 0.018 percent and 0.9 to 0.1 percent in the higher manganese range whereby the ratio of manganese to sulfur plus sulfur-equivalent copper is less than 1.7.

Similarly described, the method of this invention comprises the steps of providing a silicon-iron melt for the foregoing composition, casting the melt and hot rolling the resulting billet to produce a sheet-like body, cold rolling the hot rolled body to provide a sheet of final gauge thickness, and subjecting the resulting cold rolled sheet to a heat treatment to decarburize it and develop (110)[001] secondary recrystallization texture in it.

THE DRAWINGS

Data gathered during experiments described below are graphically illustrated in the accompanying drawings, in which.

Figure 1:
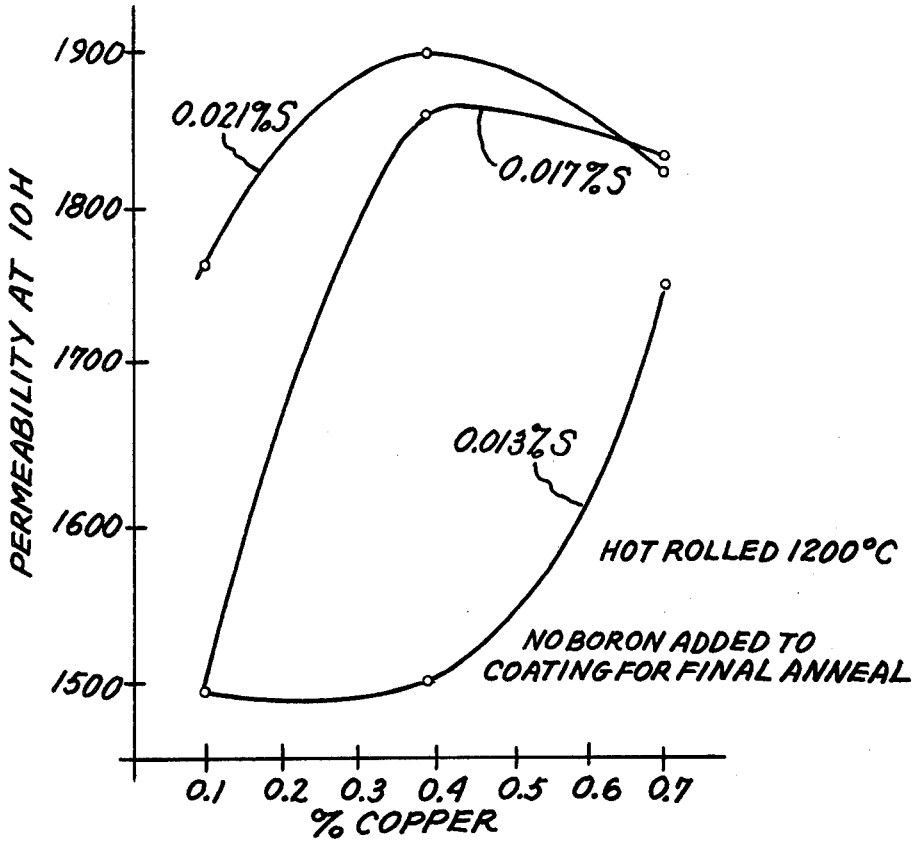
FIG. 1 is a chart on which permeability is plotted against cold rolled strip copper content, the three curves showing the effects of copper additions on strips hot rolled from 1200° C. and containing 0.035 percent manganese and amounts of sulfur from 0.013 to 0.021 percent.
Figure 3:
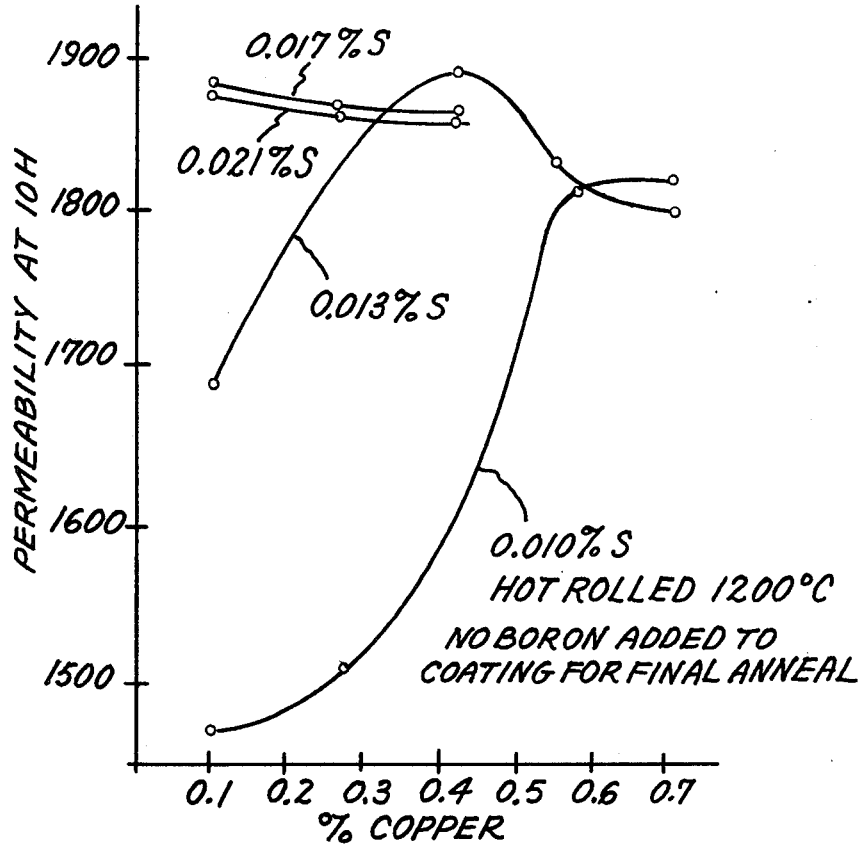
Figure 4:
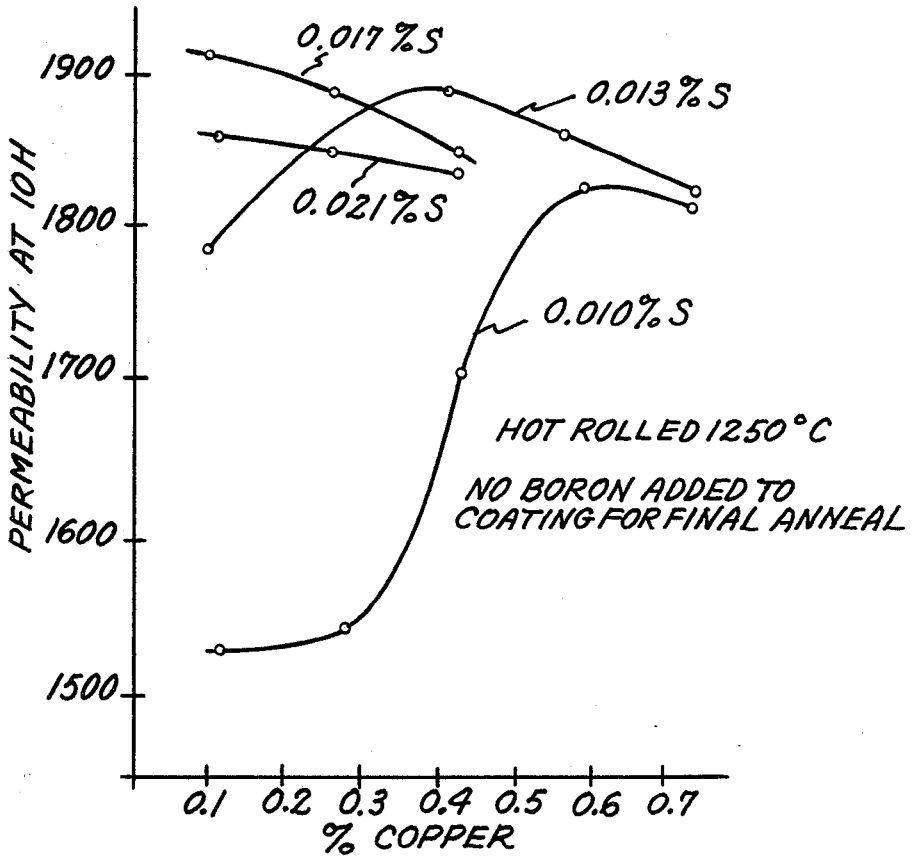

FIG. 3 is another chart like that of FIG. 1 bearing four curves showing the results obtained with strips containing 0.025 percent manganese; 0.010 percent, 0.013 percent, 0.017 percent and 0.021 percent sulfur, the strips being hot rolled from 1200° C.; and FIG. 4 is another chart like that of FIG. 1 showing results obtained with strips like those represented on FIG. 3 except that they were produced by hot rolling from 1250° C.

DETAILED DESCRIPTION OF THE INVENTION

In carrying out this invention, one may provide the cold-rolled sheet product described above by preparing a silicon-iron melt of the required chemistry, and then casting and hot rolling to intermediate thickness. Thus, the melt on pouring will contain from 2.2 to 4.5 percent silicon, from about 3 to 35 ppm boron and about 30 to 90 ppm nitrogen in the ratio range to boron of 1 to 15 parts to one, manganese from 0.02 to 0.05 percent, and sulfur and copper in amounts and ratio ranges stated above, the remainder being iron and small amounts of incidental impurities. Following anneal, the hot band is cold rolled with or without intermediate anneal to final gauge thickness and then decarburized.

The resulting fine-grained, primary recrystallized, silicon-iron sheet product in whatever manner produced is provided with a magnesia coating for the final texture-developing anneal. Preferably, the coating step is accomplished electrolytically as described in U.S. Pat. No. 3,054,732, referenced above, a uniform coating of $Mg(OH)_2$ about 0.5 mil thick thereby being applied to the sheet. Boron may be incorporated in the resulting coating in the amount and for the purpose stated above by dipping the coated strips in aqueous boric acid solution or the like.

As the final step of the process of this invention, the thus-coated sheet is heated in hydrogen to cause secondary grain growth which begins at about 950° C. As the temperature is raised at about 50° C. per hour to 1000° C., the recrystallization process is completed and heating may be carried on to up to 1175° C. if desired to insure complete removal of residual carbon, sulfur and nitrogen.

The following illustrative, but not limiting, examples of my novel process as actually carried out with the new results indicated above will further inform those skilled in the art of the nature and special utility of this invention.

EXAMPLE I

Eleven laboratory heats were melted in an air induction furnace under an argon cover using electrolytic iron and 98 percent ferrosilicon, all containing 3.1 percent silicon, 0.035 percent manganese, 5–10 parts per million boron, 40–60 parts per million nitrogen and 0.035 percent chromium. Sulfur in the form of iron sulfide was added in different amounts to the separate heats to provide a range of sulfur content from 0.012–0.021 percent. Compositions of these heats, as analyzed, and the welding behavior of material produced from them are set out in Table I.

TABLE I

| Heat | % Mn | % S | Mn/S | % Cu | Parallel Crack | Transvers Cracks/-Meter |
|---|---|---|---|---|---|---|
| 1 | 0.034 | 0.012 | 2.8 | 0.10 | No | 8 |
| 2 | 0.035 | 0.013 | 2.7 | 0.10 | No | 16 |
| 3 | 0.035 | 0.016 | 2.0 | 0.10 | No | 64 |
| 4 | 0.033 | 0.019 | 1.7 | 0.10 | Yes | 173 |
| 5 | 0.035 | 0.021 | 1.6 | 0.10 | Yes | 192 |
| 6 | 0.035 | 0.013 | 2.7 | 0.39 | No | 64 |
| 7 | 0.035 | 0.018 | 1.9 | 0.39 | No | 144 |
| 8 | 0.036 | 0.022 | 1.6 | 0.40 | Yes | 195 |
| 9 | 0.036 | 0.014 | 2.6 | 0.70 | No | 64 |
| 10 | 0.035 | 0.016 | 2.2 | 0.71 | No | 112 |
| 11 | 0.036 | 0.020 | 1.8 | 0.69 | Yes | 175 |

Slices 1.75 inch thick were cut from ingots cast from these melts and were hot rolled either from 1250° C. or from 1200° C. in six passes to a thickness of about 90 mils. Following pickling, the hot band samples were heat treated at 950° C., the time between 930° and 950° C. being about 3 minutes. The hot bands were then cold rolled directly to 10.8 mils final gauge thickness. Then Epstein-size strips of the cold-rolled material were decarburized to about 0.007 percent by heating at 800° C. in 70° F. dew point hydrogen. The decarburized strips were brushed with milk of magnesia to a weight gain of about 40 milligrams per strip and boron additions were made to some of the magnesia coated strips using a 0.5 percent boric acid solution which deposited sufficient boron on the coating that if it were all taken up by the silicon-iron, the boron content of the metal would be increased by 12 parts per million. The resulting coated strips, including both those brushed with the boric acid solution and those not so treated, were subjected to a final anneal consisting of heating at 40° C. per hour from 800° C. to 1175° C. in dry hydrogen and holding at the latter temperature for 3 hours.

Table I indicates that as the sulfur content is increased, the frequency of cracks in the weld increases and with 0.019 percent sulfur or greater, a crack also develops in the weld parallel to its length. The tests yielding these results and leading to the conclusion that the occurrence of cracks is primarily dependent upon sulfur content were carried out through simulated welding which involved running a tungsten electrode (1/16-inch diameter) above (1/32 inch) the surface of a 60-mil thick cold rolled strip specimen clamped in a fixture. With a current of 50 amperes and electrode travel at a rate of 8 inches per minute, a molten zone of 100 to 150 mils was obtained. After a pass with the electrode, the test specimens fell into three categories:

(1) those with a prominent crack running the length of the weld ("parallel crack" in Table I) and with other small cracks in the weld;

(2) those without a parallel crack but with occasional cracks in and adjacent to the weld oriented at an angle to the weld ("transverse cracks" in Table I); and (3) those free from cracks, which was confirmed by using a dye penetrant in general use for crack detection purposes.

This test exaggerates the tendency for the material to develop cracks, it being anticipated that a material that develops only transverse cracks in the evaluation would be weldable with the proper techniques.

Magnetic properties of the ultimate products of the foregoing process of this invention and those representing control specimens are set out in Table II.

TABLE II

MAGNETIC PROPERTIES OF HEATS CONTAINING 0.035% MANGANESE, ANNEALED WITH AND WITHOUT BORON IN COATING

| | | | Hot Rolled 1200° C | | | | Hot Rolled 1250° C | | | |
|---|---|---|---|---|---|---|---|---|---|---|
| | | | No B | | 12 ppm B | | No B | | 12 ppm B | |
| Heat | Mn/S | % Cu | mwpp | μ10H | mwpp | μ10H | mwpp | μ10H | mwpp | μ10H |
| 1 | 2.8 | 0.10 | 1358 | 1469 | 1363 | 1471 | 1320 | 1478 | 1327 | 1477 |
| 2 | 2.7 | 0.10 | 1381 | 1495 | 1369 | 1499 | 1391 | 1495 | 1374 | 1484 |
| 3 | 2.0 | 0.10 | 1380 | 1491 | 1299 | 1544 | 1301 | 1560 | 1331 | 1511 |
| 4 | 1.7 | 0.10 | 883 | 1780 | 747 | 1859 | 856 | 1803 | 739 | 1869 |
| 5 | 1.6 | 0.10 | 954 | 1774 | 758 | 1870 | 812 | 1859 | 760 | 1887 |
| 6 | 2.7 | 0.39 | 1286 | 1498 | 802 | 1790 | 1084 | 1654 | 725 | 1873 |
| 7 | 1.9 | 0.39 | 775 | 1865 | 698 | 1899 | 768 | 1900 | 720 | 1906 |
| 8 | 1.6 | 0.40 | 712 | 1902 | 705 | 1888 | 704 | 1900 | 775 | 1875 |
| 9 | 2.6 | 0.70 | 929 | 1751 | 764 | 1832 | 933 | 1764 | 760 | 1842 |
| 10 | 2.2 | 0.71 | 777 | 1834 | 739 | 1845 | 791 | 1827 | 744 | 1855 |
| 11 | 1.8 | 0.69 | 792 | 1830 | 780 | 1828 | 773 | 1829 | 728 | 1843 |

Figure 2:
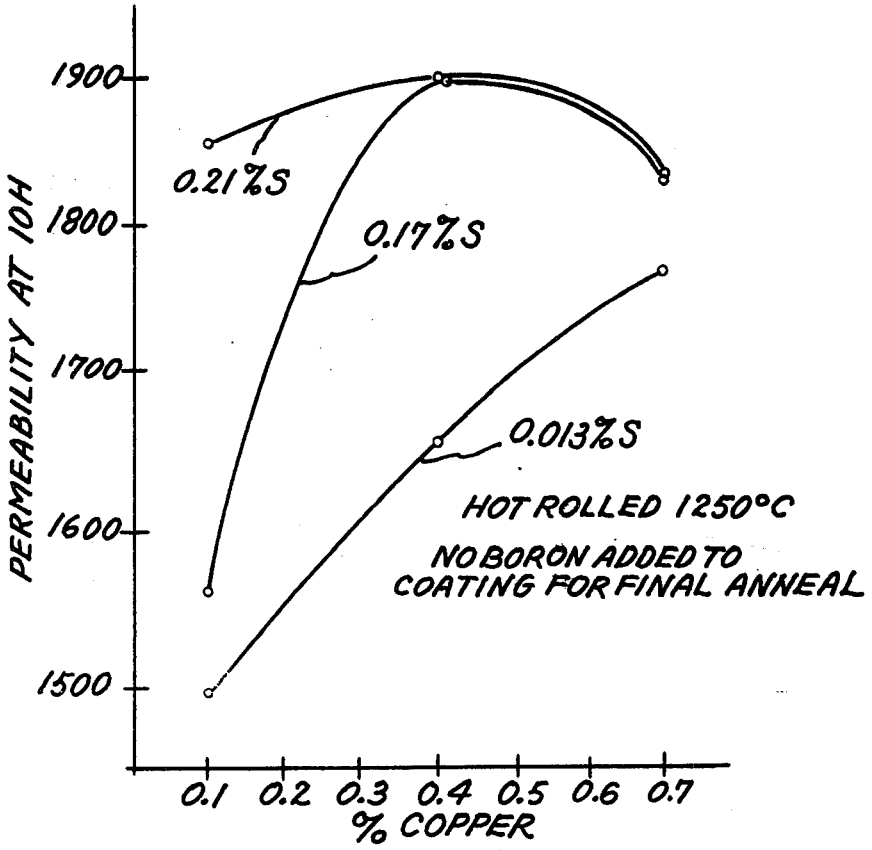
FIG. 2 is a chart like that of FIG. 1 bearing four curves representing the results obtained when strips like those of FIG. 1 were produced by hot rolling from 1250° C. rather than 1200° C.

Table II and FIGS. 1 and 2 illustrate the effect on permeability and A.C. losses of copper additions to heats with a range of sulfur contents. The effects of boron in the magnesia coating and the initial hot rolling temperature are also shown. Thus, with 0.10 percent copper there must be sufficient sulfur to provide a manganese-to-sulfur ratio of equal to or less than 1.7 if secondary recrystallization and thereby high permeability is to be obtained. Further, it is apparent that as the copper content is increased to 0.39 and 0.70 percent, complete secondary recrystallization and high permeability are obtained with substantially lower sulfur content than in alloys containing 0.10 percent copper. The ability to achieve both improved magnetic properties and improved weldability is illustrated by the behavior of Heats 5 (0.10 percent copper) and 7 (0.39 percent copper) in Tables I and II.

EXAMPLE II

In another experiment like that of Example I, 16 laboratory heats were melted in an air induction furnace under an argon cover using electrolytic iron and 98 percent ferrosilicon, all containing 3.1 percent silicon, 0.025 percent manganese and amounts of boron, nitrogen and chromium as stated in Example I. Sulfur in the form of iron sulfide was added in different amounts to the heats to provide a range of sulfur content from 0.008 to 0.022 percent. Compositions of the heats, as analyzed, and the magnetic properties of singly-oriented sheet products produced from them are set forth in Table III (without boron in the magnesia coating) and in Table IV (with boron in the magnesia coating).

TABLE III

| | | | | | Final Annealed Without Boron in Coating | | | |
|---|---|---|---|---|---|---|---|---|
| | | | | | Hot Rolled 1200° C | | Hot Rolled 1250° C | |
| Heat | % Mn | % S | ppm B | % Cu | mwpp 17kB | μ10H | mwpp 17kB | μ10H |
| Mn to S Ratio = 2.4 | | | | | | | | |
| 3642 | 0.025 | 0.010 | 6.2 | 0.11 | 1285 | 1472 | 1226 | 1530 |
| 3662 | 0.026 | 0.010 | 7.8 | 0.27 | 1282 | 1510 | 1237 | 1544 |
| 3705 | 0.024 | 0.011 | 5.8 | 0.42 | — | — | 986 | 1709 |
| 3762 | 0.023 | 0.008 | 8.1 | 0.58 | 813 | 1816 | 805 | 1832 |
| 3838 | 0.025 | 0.009 | 7.5 | 0.71 | 815 | 1818 | 780 | 1822 |
| Mn to S Ratio = 2.0 | | | | | | | | |
| 3638 | 0.025 | 0.013 | 6.7 | 0.10 | 987 | 1690 | 847 | 1784 |
| 3661 | 0.024 | 0.012 | 5.4 | 0.26 | — | — | — | — |
| 3704 | 0.023 | 0.013 | 3.9 | 0.42 | 713 | 1891 | 726 | 1888 |
| 3763 | 0.022 | 0.011 | 9.0 | 0.55 | 786 | 1833 | 756 | 1861 |
| 3839 | 0.023 | 0.013 | 7.0 | 0.71 | 871 | 1794 | 789 | 1826 |
| Mn to S Ratio = 1.4 | | | | | | | | |
| 3639 | 0.023 | 0.016 | 4.8 | 0.10 | 709 | 1884 | 682 | 1906 |
| 3660 | 0.024 | 0.018 | 5.5 | 0.26 | 738 | 1871 | 712 | 1888 |
| 3703 | 0.025 | 0.017 | 4.5 | 0.43 | 742 | 1872 | 808 | 1850 |
| Mn to S Ratio = 1.1 | | | | | | | | |
| 3640 | 0.024 | 0.021 | 6.2 | 0.11 | 714 | 1875 | 748 | 1859 |
| 3659 | 0.026 | 0.020 | 4.5 | 0.27 | 743 | 1872 | 769 | 1853 |
| 3702 | 0.022 | 0.022 | 4.8 | 0.43 | 744 | 1863 | 790 | 1838 |

TABLE IV

| | | | | | Final Annealed with Boron in Coating | | | |
|---|---|---|---|---|---|---|---|---|
| | | | | | Hot Rolled 1200° C | | Hot Rolled 1250° C | |
| Heat | % Mn | % S | ppm B | % Cu | mwpp 17kB | μ10H | mwpp 17kB | μ10H |
| Mn to S Ratio = 2.4 | | | | | | | | |
| 3642 | 0.025 | 0.010 | 6.2 | 0.11 | 1256 | 1515 | 1037 | 1648 |
| 3662 | 0.026 | 0.010 | 7.8 | 0.27 | 1012 | 1677 | 861 | 1771 |
| 3705 | 0.024 | 0.011 | 5.8 | 0.42 | — | — | 709 | 1877 |

TABLE IV-continued

| | | | | | Final Annealed with Boron in Coating | | | |
|---|---|---|---|---|---|---|---|---|
| | | | | | Hot Rolled 1200° C | | Hot Rolled 1250° C | |
| Heat | % Mn | % S | ppm B | % Cu | mwpp 17kB | μ10H | mwpp 17kB | μ10H |
| 3762 | 0.023 | 0.008 | 8.1 | 0.58 | 773 | 1861 | 765 | 1851 |
| 3838 | 0.025 | 0.009 | 7.5 | 0.71 | 794 | 1811 | 704 | 1875 |
| Mn to S Ratio = 2.0 | | | | | | | | |
| 3638 | 0.025 | 0.013 | 6.7 | 0.10 | 701 | 1866 | 699 | 1872 |
| 3661 | 0.024 | 0.012 | 5.4 | 0.26 | 731 | 1887 | 686 | 1906 |
| 3704 | 0.023 | 0.013 | 3.9 | 0.42 | 706 | 1892 | 692 | 1907 |
| 3763 | 0.022 | 0.011 | 9.0 | 0.55 | 752 | 1865 | 689 | 1889 |
| 3839 | 0.023 | 0.013 | 7.0 | 0.71 | 831 | 1789 | 755 | 1846 |
| Mn to S Ratio = 1.4 | | | | | | | | |
| 3639 | 0.023 | 0.016 | 4.8 | 0.10 | 677 | 1899 | 679 | 1898 |
| 3660 | 0.024 | 0.018 | 5.5 | 0.26 | 698 | 1900 | 694 | 1898 |
| 3703 | 0.025 | 0.017 | 4.5 | 0.43 | 702 | 1897 | 748 | 1866 |
| Mn to S Ratio = 1.1 | | | | | | | | |
| 3640 | 0.024 | 0.021 | 6.2 | 0.11 | 671 | 1888 | 692 | 1892 |
| 3659 | 0.026 | 0.020 | 4.5 | 0.27 | 724 | 1878 | 728 | 1884 |
| 3702 | 0.022 | 0.022 | 4.8 | 0.43 | 687 | 1893 | 737 | 1871 |

Slices 1.75 inch thick were cut from ingots cast from these melts and were hot rolled from 1200° C. or 1250° C. in six passes to a thickness of about 90 mils. After pickling, the hot band samples were heat treated and further processed as described in Example I, Epstein strips being prepared and coating with magnesia containing no boron or boron an amount equivalent to 12 parts per million on the basis of the metal substrate in each instance. The final anneal was also carried out as set forth in detail in Example I.

The alloys in Tables III and IV are grouped according to the ratio of manganese to sulfur. It is apparent from these data that only with a ratio of less than 1.7 can there be assurance that sulfur will be present not combined with manganese to form the compound manganese sulfide. Further, it is apparent that with manganese-to-sulfur ratios of 1.4 and 1.0 the magnetic properties decline with increasing copper content, but that with ratios greater than 1.7 (i.e., 2.0 and 2.4), the magnetic properties are improved with copper additions up to at least 0.42 percent.

What I claim as new and desire to secure by Letters Patent of the United States is:

1. The method of producing grain oriented silicon-iron sheet which comprises the steps of providing a silicon-iron melt containing 2.2 to 4.5 percent silicon, between about three and 35 parts per million boron, between about 30 and 75 parts per million nitrogen in the ratio to boron of one to 15 parts per part of boron, from 0.02 to 0.05 percent manganese, and sulfur and copper in amounts ranging respectively from 0.001 to 0.013 percent and 1.3 to 0.1 percent in the lower portion of the said manganese range and ranging respectively from 0.002 to 0.018 and 0.9 to 0.1 percent in the higher portion of said manganese range whereby the ratio of manganese to sulfur plus sulfur-equivalent copper is not greater than 1.7, casting the melt and hot rolling the resulting billet to form an elongated sheet-like body, cold rolling the hot rolled body to provide a sheet of final gauge thickness, and subjecting the resulting cold-rolled sheet to a final heat treatment to decarburize it and to develop (110)[001] secondary recrystalline texture in it.

2. The method of claim 1 in which the manganese content of the melt is between about 0.030 and 0.050 percent, the sulfur content of the melt is between 0.002 and 0.018 percent and the copper content of the melt is between about 0.9 and 0.1 percent.

3. The method of claim 1 in which the melt contains between about 0.02 and 0.03 percent manganese, between about 0.001 and 0.013 percent sulfur and between about 1.3 and 0.10 percent copper.

4. The method of claim 1 in which the melt contains about 0.035 percent manganese, about 0.016 percent sulfur, and about 0.71 percent, and in which the preparation for the final heat treatment step the cold-rolled silicon-iron sheet is provided with an electrically-insulating adherent coating containing about 12 parts per million boron on the basis of said silicon-iron sheet.

5. The method of claim 1 in which the melt contains about 0.035 percent manganese, about 0.018 percent sulfur, and about 0.39 percent copper, and in which in preparation for the final heat treatment step the cold-rolled silicon-iron sheet is provided with an electrically-insulating adherent coating containing about 12 parts per million boron on the basis of said silicon-iron sheet.

6. A cold-rolled silicon-iron sheet product containing 2.2 to 4.5 percent silicon, between about 3 and 35 parts per million boron, between about 30 and 75 parts per million nitrogen in the ratio to boron of 1 to 15 parts per part of boron, from 0.02 to 0.05 percent manganese, and sulfur and copper in amounts ranging respectively from 0.001 to 0.013 percent and 1.3 to 0.1 percent in the lower portion of the said manganese range and ranging respectively from 0.002 to 0.018 percent and 0.9 to 0.1 percent in the higher portion of said manganese range whereby the ratio of manganese to sulfur plus sulfur-equivalent copper is not greater than 1.7.

7. The cold-rolled sheet of claim 6 in which the manganese content is about 0.035 percent, the sulfur content is about 0.018 percent, and the copper content is about 0.39 percent.

* * * * *